US008042509B2

(12) United States Patent
Shoji

(10) Patent No.: US 8,042,509 B2
(45) Date of Patent: Oct. 25, 2011

(54) CAM CAP

(75) Inventor: Junpei Shoji, Toyota (JP)

(73) Assignee: Toyota Jidosha Kabushiki Kaisha, Aichi-Ken (JP)

( * ) Notice: Subject to any disclaimer, the term of this patent is extended or adjusted under 35 U.S.C. 154(b) by 428 days.

(21) Appl. No.: 12/375,536

(22) PCT Filed: Aug. 31, 2007

(86) PCT No.: PCT/IB2007/002507

§ 371 (c)(1),
(2), (4) Date: Jan. 29, 2009

(87) PCT Pub. No.: WO2008/026057

PCT Pub. Date: Mar. 6, 2008

(65) Prior Publication Data

US 2009/0194049 A1 Aug. 6, 2009

(30) Foreign Application Priority Data

Aug. 31, 2006 (JP) ..... 2006-235796

(51) Int. Cl.
*F01M 9/10* (2006.01)

(52) U.S. Cl. ..... 123/90.38; 123/90.12; 123/90.34; 123/193.5

(58) Field of Classification Search ..... 123/90.12, 123/90.13, 90.33, 90.34, 90.38, 193.3, 193.5
See application file for complete search history.

(56) References Cited

U.S. PATENT DOCUMENTS 7,162,986 B2 * 1/2007 Yoshijima et al. ..... 123/90.38

FOREIGN PATENT DOCUMENTS

| | | | |
|---|---|---|---|
| EP | 0 318 303 | A1 | 5/1989 |
| EP | 1 057 982 | A2 | 12/2000 |
| JP | 2542525 | Y2 | 4/1997 |
| JP | 2002-242616 | A | 8/2002 |
| JP | 2003-222003 | A | 8/2003 |
| JP | 2003-227321 | A | 8/2003 |
| JP | 2004-92567 | A | 3/2004 |
| JP | 1 422 387 | A1 | 5/2004 |
| JP | 2004-293329 | A | 10/2004 |
| JP | 2005-42657 | A | 2/2005 |
| JP | 2006-189010 | A | 7/2006 |
| JP | 2006-220073 | A | 8/2006 |

OTHER PUBLICATIONS

Journal of Technical Disclosure No. JP 2002-2598—Jun. 3, 2002.
Japanese Office Action for corresponding JP Patent Application No. 2006-235796 drafted Jul. 4, 2008.

* cited by examiner

*Primary Examiner* — Ching Chang
(74) *Attorney, Agent, or Firm* — Sughrue Mion, PLLC

(57) ABSTRACT

A cam cap has a wall portion that extends between two cam cap portions integrally formed and having connection portions respectively, and therefore the rigidity of the cam cap is high and thus the relative positional accuracies of oil passage connection faces of the connection portions are high even after the cam cap is mounted on an internal combustion engine.

7 Claims, 4 Drawing Sheets

CAM CAP

BACKGROUND OF THE INVENTION

1. Field of the Invention

The invention relates to a cam cap for an internal combustion engine, having a cam cap portion for the intake camshaft and a cam cap portion for the exhaust camshaft, which are integrally formed.

2. Description of the Related Art

Japanese Patent Application Publication No. 2003-227321 (JP-A-2003-227321) proposes a cam cap having an intake side cam cap portion and an exhaust side cam cap portion that are integrally formed to support the intake camshaft and the exhaust camshaft of an internal combustion engine on journal bearings formed at the cylinder head or the cam housing, respectively. This cam cap involves oil passages through which hydraulic oil is supplied to and drained from a single oil control valve (called "hydraulic pressure control valve" in the publication) provided in the cylinder head cover, and hydraulic oil is supplied, at a pressure adjusted by the oil control valve, to only one of the camshafts. More specifically, the pressure-adjusted hydraulic oil is supplied to a variable valve timing mechanism provided at one end of one of the camshafts to adjust the operation timing of the exhaust valves or the intake valves as needed. Note that, in the specification of the present invention, the phrase "pressure adjusting" includes starting and stopping the application of hydraulic pressure, as well as adjusting the hydraulic pressure level.

If it is required to modify a cam cap structured as described above to enable to adjust the operation timings of both of the intake and exhaust valves, a cam cap having a shape symmetrical to the shape of the foregoing cam cap is added and another oil control valve is provided on the cylinder head cover and hydraulic oil supply and drain passages for the new oil control valve are formed additionally.

In this structure, the oil passages for the two oil control valves provided on the single cylinder head cover are connected to corresponding oil passages formed in the two cam caps, respectively, by mating corresponding oil passage connection faces to each other and press-fitting them together. Although the two oil passage connection faces on the oil control valve side are formed on the single cylinder head cover, the oil passage connection faces on the cam cap side are formed on the two cam caps, respectively. Thus, even though the relative positional accuracies of the two oil passage connection faces formed at the cylinder head cover are high, the relatively positional accuracies of the corresponding two oil passage connection faces on the cam cap side, which are separately formed on the two cam caps, may not be high. Therefore, the contact pressure between the mating oil passage connection faces may decrease in some cases.

Meanwhile, it is also possible to form oil supply and drain passages for the two oil control valves in a single cam cap. In this case, too, oil passages and oil passage connection faces need to be formed for the intake aide cam cap portion and the exhaust cam cap portion of the cam cap, respectively. In this case, because the rigidity of the cam cap elongated to incorporate the two cam cap portions is low, even if the relative positional accuracies of the oil passage contact faces of the two cam cap portions are high when the cam cap is manufactured, the relative positional accuracies of the oil passage contact faces may decrease due to deformation of the cam cap that occurs when it is bolted to the cylinder head or to the cam housing.

SUMMARY OF THE INVENTION

The invention provides a cam cap having an intake side cam cap portion and an exhaust side cam cap portion that are integrally formed and having a rigidity that is high enough to maintain high relative positional accuracies of the two oil passage connection faces even after the cam cap is mounted on an internal combustion engine.

An aspect of the invention relates to a cam cap for an internal combustion engine, having an intake side cam cap portion for an intake camshaft and an exhaust side cam cap portion for an exhaust camshaft, which are integrally formed. This cam cap has: two connection portions that are formed at the intake side cam cap portion and the exhaust side cam cap portion, respectively, so as to protrude from the side of the cam cap opposite from where the camshaft support faces of the intake and exhaust side cam cap portions are formed, the connection portions having oil passage connection faces that are connected to corresponding oil passage connection faces of a cylinder head cover at which the openings of oil passages leading to ports of oil control valves are formed, respectively, so that oil passages in the exhaust and intake side cam cap portions are connected to the respective oil passages in the cylinder head cover; a wall portion that extends between the connection portion of the intake side cam cap portion and the connection portion of the exhaust side cam cap portion; and a hydraulic oil distribution passage that is formed in the wall portion and through which a hydraulic oil supply passage formed in the connection portion of the intake side cam cap portion and a hydraulic oil supply passage formed in the connection portion of the exhaust side cam cap portion communicate with each other; a hydraulic oil inlet passage that communicates with the hydraulic oil distribution passage and via which hydraulic oil is externally supplied into the hydraulic oil distribution passage.

According to the structure described above, the two connection portions are connected to each other via the wall portion. The presence of the wall portion increases the rigidity of the entire cam cap. Therefore, the relative positional accuracies of the two oil passage connection faces can be maintained high even after the cam cap is mounted on the internal combustion engine.

Further, the hydraulic oil distribution passage is formed so as to connect the hydraulic oil supply passages in the two connection portions. Therefore, the wall portion can be made light in weight. That is, the rigidity of the entire cam cap can be increased while minimizing an increase in its weight.

The above-described cam cap may be such that the wall portion is formed such that the entire part of the exhaust side cam cap portion including the connection portion and the entire part of the intake side cam cap portion including the connection portion are connected to each other via the wall portion. According to this structure, the rigidity of the entire cam cap is further increased while the presence of the hydraulic oil distribution passage minimizes an increase in the weight of the cam cap.

According to this structure, further, because the two cam cap portions are entirely connected via the wall portion, if hydraulic oil is splashed, the splashed oil is blocked by the wall portion, and therefore the amount of hydraulic oil discharged together with the blow-by gas decreases accordingly. Thus, the waste of hydraulic oil can be minimized.

Further, the above-described cam cap may be such that the upper edge portion of the wall portion extends straight. In particular, by forming the upper edge portion of the wall portion in a straight shape, the rigidity of the cam cap is further increased, and the hydraulic oil distribution passage can be easily formed. Moreover, splashed hydraulic oil can be reliably blocked and therefore the waste of hydraulic oil can be minimized.

Further, the above-described cam cap may be such that the upper edge portion of the wall portion is cylindrical, having a diameter larger than the thickness of the wall portion measured below the upper edge portion and extending between the connection portion of the intake side cam cap portion and the connection portion of the exhaust side cam cap portion, and the hydraulic oil distribution passage extends, in the upper edge portion, straight between the hydraulic oil supply passage in the connection portion of the intake side cam cap portion and the hydraulic oil supply passage in the connection portion of the exhaust side cam cap portion such that the entire part of the hydraulic oil distribution passage is located higher than the camshaft support faces of the exhaust and intake side cam cap portions.

By forming the upper edge portion of the wall portion as described above, the rigidity of the wall portion can be made high for its weight. Further, because the hydraulic oil distribution passage extends straight such that the entire part of the hydraulic oil distribution passage is located higher than the camshaft support faces of the cam cap portions, there is no possibility that the can shaft support faces of the cam cap portions are penetrated when the hydraulic oil distribution passage is being formed by drilling or the like. Therefore, the hydraulic oil distribution passage can be easily formed.

Further, the above-described cam cap may be such that the hydraulic oil inlet passage is formed in the wall portion such that the lower opening of the hydraulic oil inlet passage is formed at the bottom face of the cam cap and the upper end of the hydraulic oil inlet passage is connected to an intermediate portion of the hydraulic oil distribution passage.

If the hydraulic oil inlet passage is formed in the wall portion as well as the hydraulic oil distribution passage, hydraulic oil can be easily supplied to both the connection portions.

Further, the above-described cam cap may be such that the openings of the hydraulic oil supply passages for supplying hydraulic oil to the respective oil control valves and the openings of pressure-adjusting oil passages that supply or receive hydraulic oil at a pressure adjusted by the oil control valves are formed at the oil passage connection faces of the connection portions of the exhaust and intake side cam cap portions and the lower openings of the pressure-adjusting oil passages are formed at the camshaft support faces of the exhaust and intake side cam cap portions.

Because the openings of the respective oil passages are formed as described above, by connecting the oil passage connection faces of the respective connection portions to the corresponding oil passage connection faces of the cylinder head cover, hydraulic oil can be supplied from the hydraulic oil distribution passage and the hydraulic oil supply passages to the oil control valves, respectively. Further, hydraulic oil can be supplied or discharged from the pressure-adjusting oil passages to the oil passages in the intake and exhaust camshafts through the pressure adjustment by the oil control valves. As such, the variable valve timing mechanisms provided at the exhaust and intake camshafts are hydraulically driven to adjust the operation timings of the intake and exhaust valves as needed.

Further, the above-described cam cap may be such that the pressure-adjusting oil passage at the connection portion of each of the exhaust and intake side cam cap portions consists of two pressure-adjusting oil passages, and each of the oil control valves has a function of selectively supplying hydraulic oil from the hydraulic oil supply passage to one of the two pressure-adjusting oil passages while discharging hydraulic oil from the other of the two pressure-adjusting oil passages.

In this case, because the oil passages needed for the hydraulic drive of the two oil control valves are collectively formed in a single cam cap, there is no need to provide oil passages for the oil control valves in other cam caps, the cylinder head, and the cam housing. Therefore, the structure can be made compact, and the oil passages can be easily formed.

BRIEF DESCRIPTION OF THE DRAWINGS

The features, advantages thereof, and technical and industrial significance of this invention will be better understood by reading the following detailed description of preferred embodiments of the invention, when considered in connection with the accompanying drawings, in which.

DETAILED DESCRIPTION OF THE EMBODIMENTS

First Exemplary Embodiment

Figure 1A:
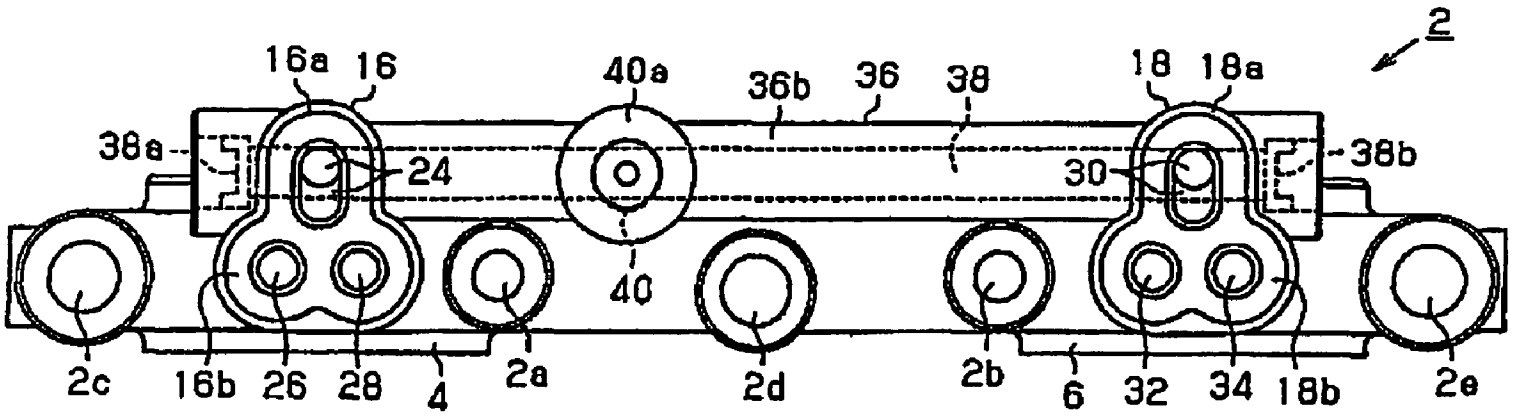
FIG. 1A is a view showing the top side of a cam cap according to the first exemplary embodiment of the invention.
Figure 1B:
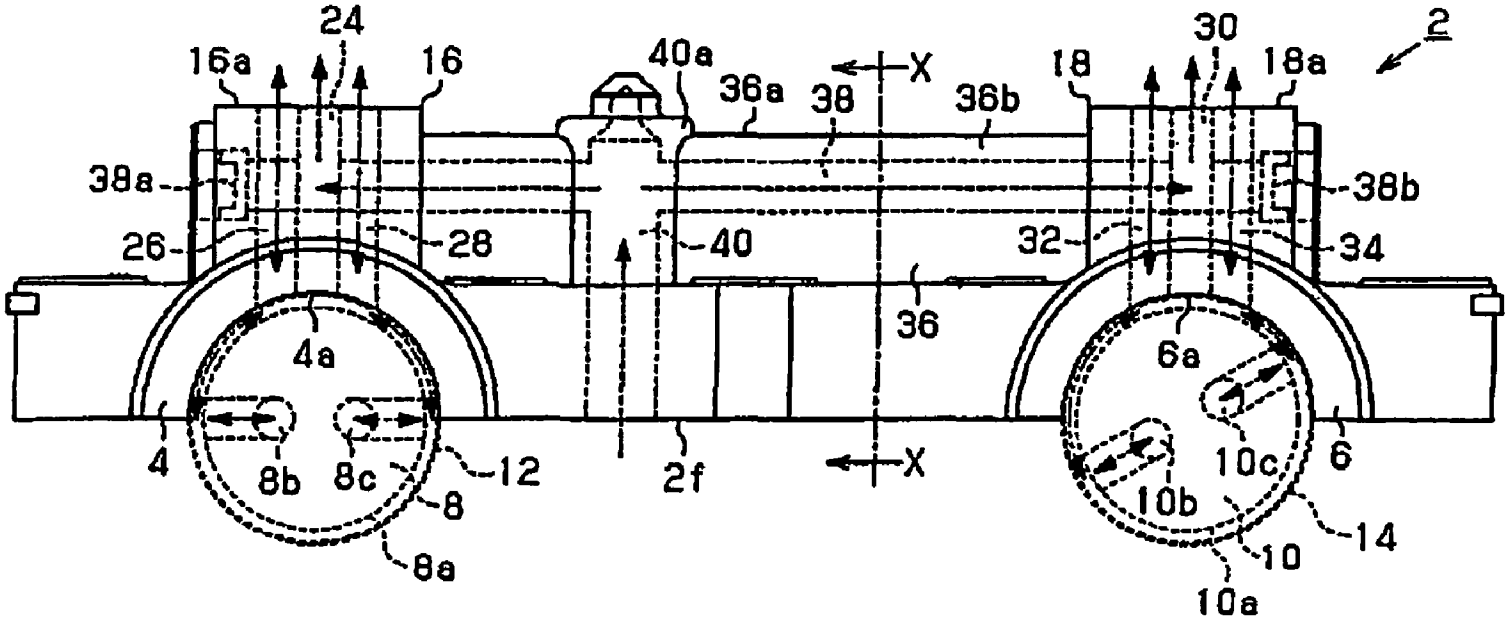
FIG. 1B is a view showing the front side of the cam cap according to the first exemplary embodiment.
Figure 2A:
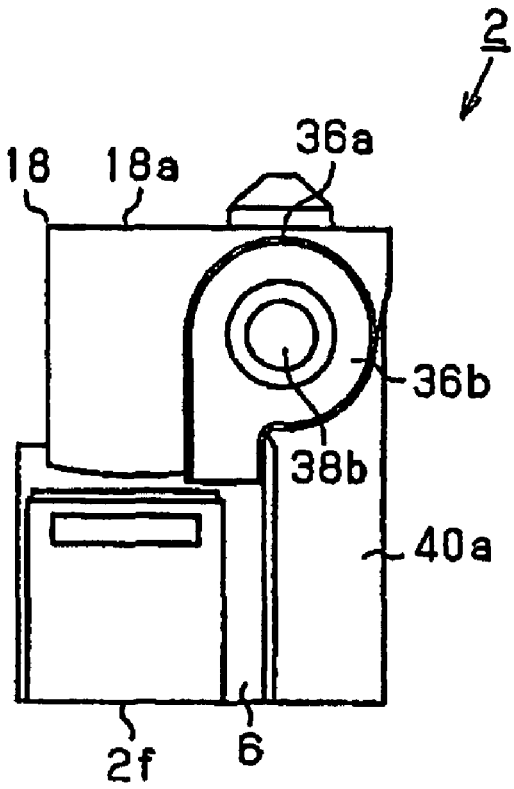
FIG. 2A is a view showing the right side of the cam cap according to the first exemplary embodiment.
Figure 2B:
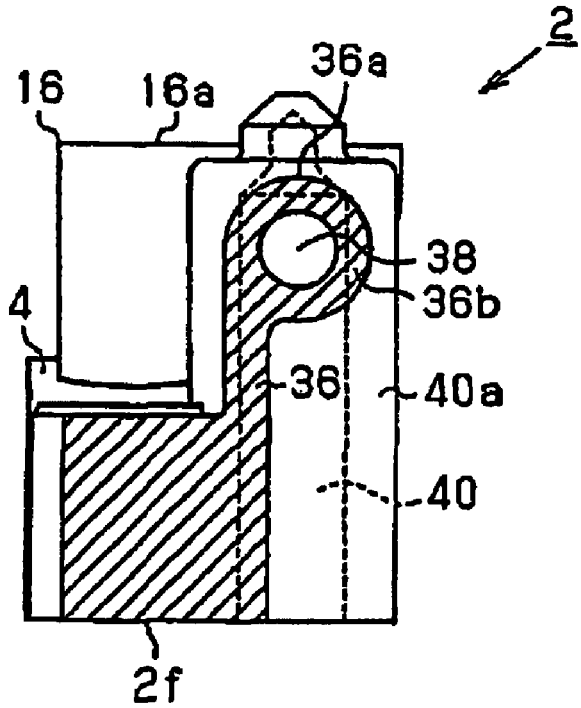
FIG. 2B is a cross-sectional view taken along the line X-X indicated in FIG. 1B.
Figure 3:
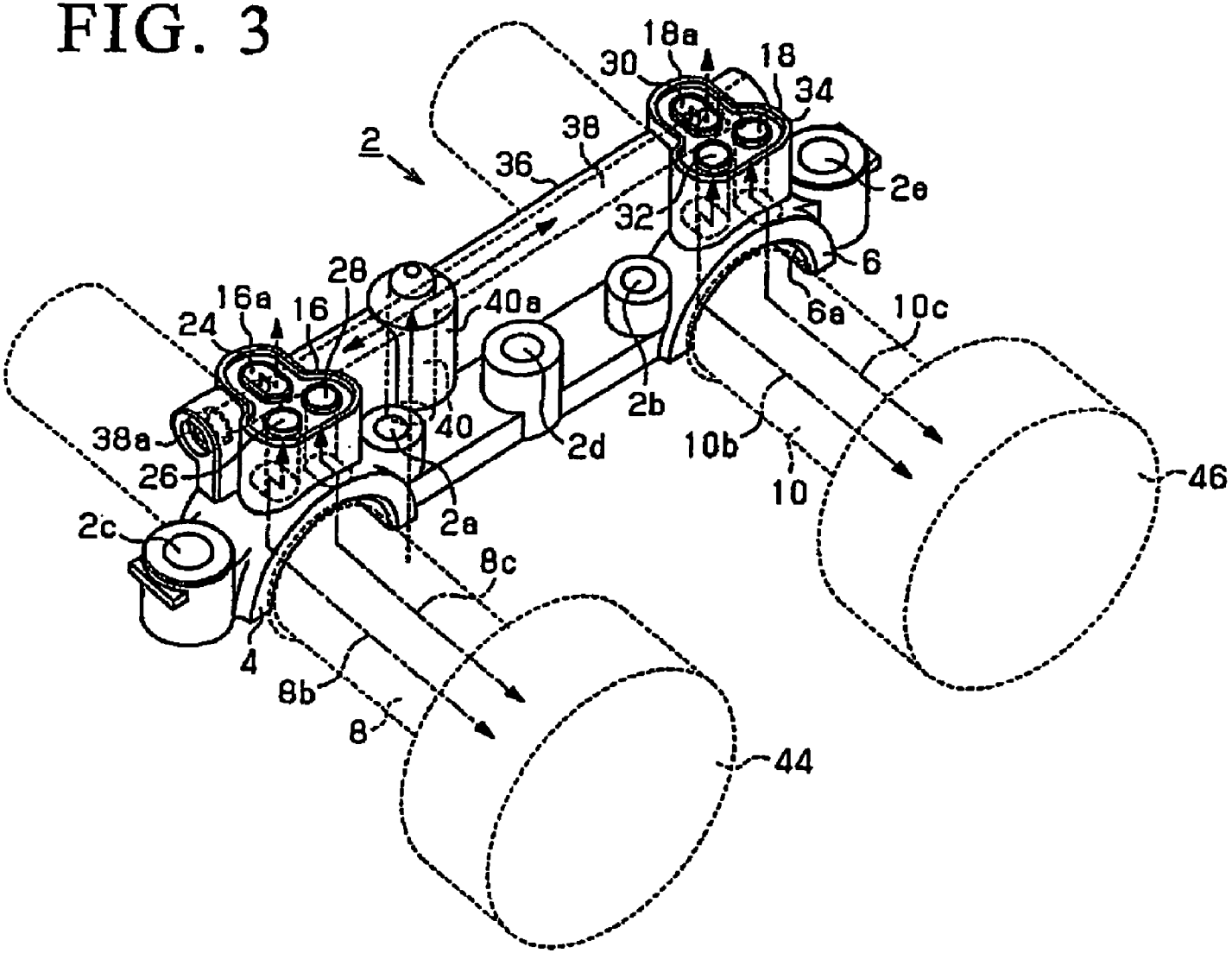
FIG. 3 is a perspective view of the cam cap according to the first exemplary embodiment.
Figure 4:
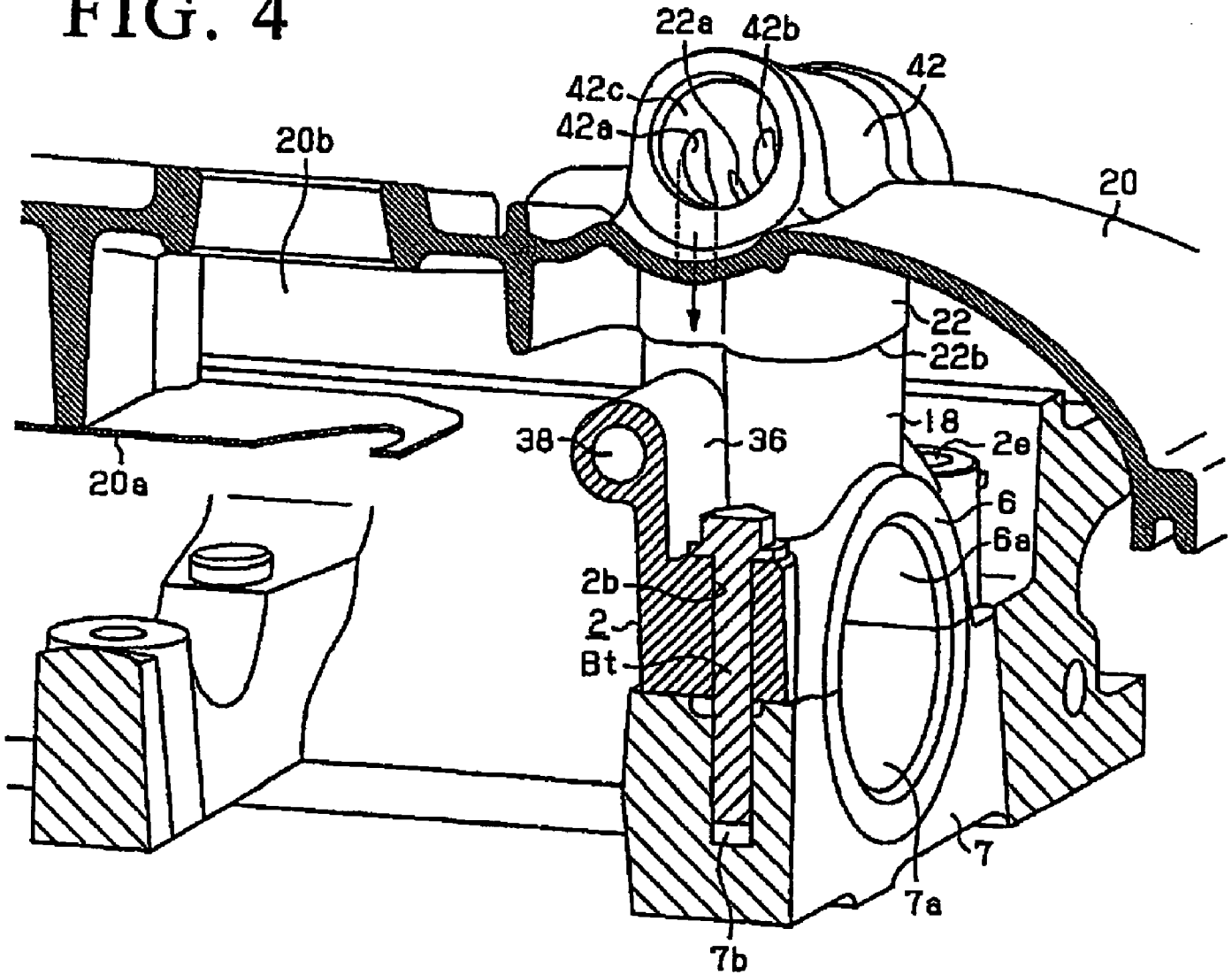
FIG. 4 is a perspective cutaway view of the cam cap according to the first exemplary embodiment when it is mounted on an internal combustion engine.

FIG. 1A is a view showing the top side of a cam cap 2 according to the first exemplary embodiment of the invention, and FIG. 1B is a view showing the front side of the cam cap 2. FIG. 2A is a view showing the right side of the cam cap 2 as viewed in FIG. 1A. FIG. 2B is a cross-sectional view taken along the line X-X indicated in FIG. 1B. FIG. 3 is a perspective view of the cam cap 2. FIG. 4 is a perspective cutaway view showing the main portion of the cam cap 2 mounted on in an internal combustion engine.

The cam cap 2 is formed by grinding a casting of metal (e.g., aluminum). The cam cap 2 has an exhaust side cam cap portion 4 (the portion on the left in FIG. 1) and an intake side cam cap portion 6 (the portion on the right in FIG. 1), which are integrated with each other. The exhaust side cam cap portion 4 has a camshaft support face 4*a* having a semi-cylindrical outline, and the intake side cam cap portion 6 has a camshaft support face 6*a* having a semi-cylindrical outline. When the cam cap 2 is bolted on a cam housing 7 (or directly on the cylinder head of the internal combustion engine), as shown in FIG. 3, an exhaust camshaft 8 is rotatably supported between the camshaft support face 4*a* and a camshaft support face 7*a* formed on the cam housing 7, and an intake camshaft 10 is rotatably supported between the camshaft support face 6*a* and another camshaft support face 7*a* formed on the cam housing 7. The cam cap 2 is secured to the cam housing 7 by inserting bolts Bt into bolt insert holes 2*a*, 2*b* of the cam cap 2 and then fastening them into threaded holes 7*b* of the cam housing 7. The cam cap 2 has three other bolt insert holes 2*c*, 2*d*, 2*e* and the cam housing 7 has three bolt insert holes formed at positions corresponding the bolt insert holes 2*c*, 2*d*, 2*e*, respectively. The cam cap 2 and the cam housing 7 are together secured to the cylinder head by inserting bolts into the bolt insert holes 2*c*, 2*d*, 2*e* of the cam cap 2 and then into the corresponding three bolt insert holes of the cam housing 7 and then fastening the bolts into corresponding threaded holes formed in the cylinder head. When the cam cap 2 is mounted, a plain bearing 12 made of metal is put between the exhaust camshaft 8 and the shaft support faces 4*a*, 7*a* and a plain bearing 14 made of metal is put between the intake camshaft 10 and the shaft support faces 6*a*, 7*a*.

Connection portions 16, 18 are formed at the exhaust side cam cap portion 4 and the intake side cam cap portion 6, respectively. The connection portions 16, 18 protrude from the sides opposite from the camshaft support face 4*a* and the camshaft support face 6*a*, respectively. Oil passage connection faces 16*a*, 18*a* are provided at the upper ends of the connection portions 16, 18. The connection portions 16, 18 are connected to the corresponding connection portions of a cylinder head cover 20 shown in FIG. 4. That is, the oil passage connection faces 16*a*, 18*a* of the connection portions 16, 18 are connected to oil passage connection faces 22*b* formed at the lower ends of connection portions 22 protruding downward from the bottom side of the cylinder head cover 20. The outline of the oil passage connection faces 16*a*, 18*a* is substantially the same as the outline of the oil passage connection faces 22*b*.

The oil passage connection faces 22*b* of the connection portions 22 of the cylinder head cover 20 are completely flat except where the openings of oil passages are formed, On the other hand, the connection portions 16, 18 of the cam cap 2 are formed such that the peripheral edges of the openings of oil passages 24, 26, 28, 30, 32, 34 and the peripheral edges of the oil passage connection faces 16*a*, 18*a* are formed in the shape of "bank" by being raised upward with respect to other portions, whereby gasket grooves 16*b*, 18*b* are formed in the oil passage connection faces 16*a*, 18*a*. A gasket having a shape surrounding the openings of the oil passages 24, 26, 28 is put in the gasket groove 16*b* of the oil passage connection face 16*a*. This gasket seals between the connection portion 16 of the cam cap 2 and the corresponding connection portion 22 of the cylinder head cover 20 and thus prevents leakage of hydraulic oil when they are connected to each other. Likewise, a gasket having a shape surrounding the openings of the oil passages 30, 32, 34 is put in the gasket groove 18*b* of the oil passage connection face 18*a*. This gasket seals between the connection portion 18 of the cam cap 2 and the corresponding connection portion 22 of the cylinder head cover 20 and thus prevents leakage of hydraulic oil when they are connected to each other.

A wall portion 36 is integrally formed upright between the exhaust side cam cap portion 4 and the intake side cam cap portion 6 of the cam cap 2. The height of an upper end 36*a* of the wall portion 36 is almost equal to the height of the connection portions 16, 18. In the first exemplary embodiment, more specifically, the upper end 36*a* of the wall portion 36 is located slightly below the oil passage connection face 16*a*, 18*a*. That is, the entire part of the exhaust side cam cap portion 4 including the connection portion 16 and the entire part of the intake side cam cap portion 6 including the connection portion 18 are connected to each other via the wall portion 36.

An upper edge portion 36*b* of the wall portion 36 is cylindrical and extends straight such that the connection portions 16, 18 of the camshaft cam cap portions 4, 6 are connected to each other via the upper edge portion 36*b*. The diameter of the upper edge portion 36*b* is larger than the thickness of the wall portion 36 measured below the upper edge portion 36*b*. Within the upper edge portion 36*b* is formed a straight hydraulic oil distribution passage 38 that connects the hydraulic oil supply passage 24 in the connection portion 16 and the hydraulic oil supply passage 30 in the connection portion 18. The entire part of the hydraulic oil distribution passage 38 is located higher than the camshaft support face 4*a* of the exhaust side cam cap portion 4 and the camshaft support face 6*a* of the intake side cam cap portion 6. The hydraulic oil distribution passage 38 is formed in a straight shape by casting or drilling. Plugs 38*a*, 38*b* are press-fit to the ends of the hydraulic oil distribution passage 38 to prevent leakage of hydraulic oil from the same ends.

In the wall portion 36, a hydraulic oil inlet passage 40 is formed, which communicates with and perpendicularly intersects with the hydraulic oil distribution passage 38. The lower opening of the hydraulic oil inlet passage 40 is formed at a bottom face 2*f* of the cam cap 2. When the cam cap 2 is mounted on the cam housing 7 (or directly on the cylinder head), hydraulic oil is supplied from the cam housing 7 (or from the cylinder head) into the hydraulic oil inlet passage 40 through the lower opening of the hydraulic oil inlet passage 40. That is, hydraulic oil that has been pressurized up to a given pumping pressure is supplied into the hydraulic oil distribution passage 38 via the hydraulic oil inlet passage 40. Hydraulic oil is then supplied from the hydraulic oil distribution passage 38 to the hydraulic oil supply passages 24, 30 of the connection portions 16, 18. In the first exemplary embodiment, an oil filter is provided at the hydraulic oil inlet passage 40, and the hydraulic oil inlet passage 40 and a peripheral wall portion 40*a* defining the hydraulic oil inlet passage 40 are formed to be large in diameter, and the upper portion of the hydraulic oil inlet passage 40 and the upper portion of the peripheral wall portion 40*a* are tapered down upward. Meanwhile, if no oil filter is provided at the hydraulic oil inlet passage 40, the hydraulic oil inlet passage 40 and the peripheral wall portion 40*a* may be formed such that their diameters coincide with the diameters of the hydraulic oil distribution passage 38 and the upper edge portion 36*b*, respectively.

At the connection portions 22 of the cylinder head cover 20, the hydraulic oil supply passages 24, 30 are connected to corresponding hydraulic oil supply passages 22*a* (Refer to FIG. 4), respectively. Note that FIG. 4 shows one of the connection portions 22 of the cylinder head cover 20 only and the structure of the other connection portion 22 is the same as that shown in FIG. 4. Hydraulic oil is supplied from each of the hydraulic oil supply passages 22*a* to the inlet port of an oil control valve (will be referred to as "OCV") mounted in a mounting hole 42*c* of a mounting portion 42. Note that FIG. 4 shows a state before the OCVs are mounted in the mounting holes 42*c* of the mounting portions 42. The OCVs are passage switching valves that are electromagnetically driven. Each OCV has one inlet port, two pressure-adjusting ports, and two discharge (drain) ports. Each OCV has a function of selectively connecting the inlet port to one of the pressure-adjusting ports while connecting the other of the pressure-adjusting ports to a corresponding one of the discharge ports. The pressure-adjusting ports of each OCV are connected to the openings of two pressure-adjusting oil passages in the mounting hole 42*c*, and these two pressure-adjusting passages are connected to the pressure-adjusting passages of the corresponding connection portion of the cam cap 2 (i.e., the pressure-adjusting passages 26, 28 at the connection portion 16 or the pressure-adjusting passages 32, 34 at the connection portion 18). According to this structure, through the oil passage switching operation of the OCVs, hydraulic oil is selectively supplied to the pressure-adjusting passages 26, 32 or to the pressure-adjusting passages 28, 34.

The two discharge ports of each OCV are connected to discharge holes 42*a*, 42*b* at the mounting hole 42*c* and thus communicate with the space below the cylinder head cover 20. As such, for example, when the inlet ports of the OCVs are selectively connected to the pressure-adjusting passages 26, 32, respectively, and hydraulic oil is supplied into the pressure-adjusting passages 26, 32, hydraulic oil is discharged (drained) from each of the pressure-adjusting passages 28, 34 into the cylinder head cover 20 through the connection portion 22, the OCV, and the corresponding one of the discharge holes 42*a*, 42*b*, as indicated by the arrow in FIG. 4. On the other hand, when the inlet ports of the OCVs are connected to the pressure-adjusting passages 28, 34, respectively, and hydraulic oil is supplied into the pressure-adjusting passages 28, 34, hydraulic oil is discharged (drained) from each of the pressure-adjusting passages 26, 32 into the cylinder head cover 20 through the connection portion 22, the OCV, and the corresponding one of the discharge holes 42*a*, 42*b*.

The lower openings of the pressure-adjusting passages 26, 28 are formed in the camshaft support face 4*a*, and the lower openings of the pressure-adjusting passages 32, 34 are formed in the camshaft support face 6*a*. The pressure-adjusting passages 26, 28, 32, 34 are connected to the valve-advance chambers and the valve-retard chambers of variable valve timing mechanisms (will be referred to as "VVTs") 44, 46 via the plain bearings 12, 14, peripheral grooves 8*a*, 10*a* of the camshafts 8, 10, and the pressure-adjusting oil passages 8*b*, 8*c*, 10*b*, 10*c* formed in the camshafts 8, 10, respectively. As such, through the control of the OCVs, hydraulic oil is selectively supplied to the pressure-adjusting oil passages 26, 32 or to the pressure-adjusting oil passages 28, 34, whereby the VVTs 44, 46 are driven to change the rotational phases of the camshafts 8, 10 with respect to the crankshaft and thus advance or retard the operation timing of the intake valves and the exhaust valves as needed. At this time, as mentioned above, if hydraulic oil is supplied to the pressure-adjusting oil passages 26, 32, hydraulic oil is discharged from the pressure-adjusting passage 28, 34, and if hydraulic oil is supplied to the pressure-adjusting oil passages 28, 34, hydraulic oil is discharged from the pressure-adjusting passages 26, 32.

The first exemplary embodiment described above provides the following advantages.

(A) According to the structure employed in the first exemplary embodiment, the exhaust side cam cap portion 4 having the connection portion 16 and the intake side cam cap portion 6 having the connection portion 18 are connected to each other via the wall portion 36. This structure increases the rigidity of the cam cap 2 having the integrally formed exhaust and intake side cam cap portions 4, 6, and the increased rigidity of the cam cap 2 makes it possible to maintain high relative positional accuracies of the oil passage connection faces 16*a*, 18*a* even after the cam cap 2 is mounted on the internal combustion engine. As a result, the sealing performance between the oil passage connection faces 16*a*, 18*a* of the cam cap 2 and the oil passage connection faces 22*b* of the cylinder head cover 20 improves, and therefore oil leakage can be more effectively prevented. Accordingly, the response of the VVTs 44, 46 improves, and the possibility of errors in the control of the VVTs 44, 46 due to leakage of hydraulic oil decreases.

According to the structure employed in the first exemplary embodiment, further, because the hydraulic oil distribution passage 38 is formed so as to connect the hydraulic oil supply passage 24 in the connection portion 16 and the hydraulic oil supply passage 30 in the connection portion 18, the wall portion 36 can be made light in weight. Further, because the upper edge portion 36*b* of the wall portion 36 is cylindrical and its diameter is larger than the thickness of the wall portion 36 measured below the upper edge portion 36*b* and the hydraulic oil distribution passage 38 is formed straight in the cylindrical upper portion 36*b*, the rigidity of the wall portion 36 is high for its weight. That is, according to this structure, the rigidity of the wall portion 36 can be increased while minimizing an increase in the weight of the wall portion 36.

(B) According to the structure employed in the first exemplary embodiment, further, because the entire part of the exhaust side cam cap portion 4 including the connection portion 16 and the entire part of the intake side cam cap portion 6 including the connection portion 18 are connected to each other via the wall portion 36 in the region below the upper end 36*a* of the wall portion 36, no gap is present below the upper end 36*a* of the wall portion 36. There is a blow-by gas room 20*b* below the cylinder head cover 20, which is covered by a metal plate 20*a*. The wall portion 36 is located between the blow-by gas room 20*b* and the area where the timing chain is provided (the area on the right side of the cam cap 2 in FIG. 4). Thus, the wall portion 36 is like a tall barrier standing in front of the blow-by gas room 20*b* and continuously extending between the exhaust side cam cap portion 4 and the intake side cam cap portion 6. Therefore, even if hydraulic oil is splashed during the operation of the internal combustion engine, the splashed oil is blocked by the wall portion 36 and thus prevented from reaching the blow-by gas room 20*b*. As a result, the amount of hydraulic oil discharged together with the blow-by gas decreases, that is, the waste of hydraulic oil can be minimized.

(C) According to the structure employed in the first exemplary embodiment, further, because the upper edge portion 36*b* of the wall portion 36 extends straight, it is possible to form the hydraulic oil distribution passage 38 in a straight shape in the upper edge portion 36*b*. Thus, the hydraulic oil distribution passage 38 can be easily formed by casting, drilling, etc. Further, because the entire part of the hydraulic oil distribution passage 38 is located higher than the camshaft support face 4*a* of the exhaust side cam cap portion 4 and the camshaft support face 6*a* of the intake side cam cap portion 6, there is no possibility that the camshaft support faces 4*a*, 6*a* are penetrated by mistake when the hydraulic oil distribution passage 38 is formed by drilling, or the like. That is, the hydraulic oil distribution passage 38 can be easily formed.

(D) According to the structure employed in the first exemplary embodiment, further, because the hydraulic oil inlet passage 40 is formed in the wall portion 36 and connected to an intermediate portion of the hydraulic oil distribution passage 38, hydraulic oil can be easily supplied to the connection portions 16, 18.

(E) According to the structure employed in the first exemplary embodiment, further, because the two pressure-adjusting oil passages (pressure-adjusting oil passages 26, 28 or pressure-adjusting oil passages 32, 34) are formed in each of the connection portions 16, 18 and each OCV has a function of selectively supplying hydraulic oil from the oil supply passage 24 (30) to one of the two pressure-adjusting oil passages 26, 28 (32, 34) while discharging hydraulic oil from the other. Therefore, the oil passages needed to drive the two OCVs hydraulically can be collectively formed in the cam cap 2, and this eliminates the necessity of providing OCV oil passages in other cam caps, the cylinder head, and the cam housing 7. Thus, the structure can be made compact, and also oil passages can be easily formed.

Other Exemplary Embodiment (a) While the wall portion 36 includes the portion below the cylindrical upper portion 36*b* in the first exemplary embodiment described above, if splashed oil can be blocked by other portion or member of the cam cap 2, the portion of the wall portion 36 below the upper edge portion 36*b* may be removed except the peripheral wall portion 40*a* including the hydraulic oil inlet passage 40. That is, because the upper edge portion 36*b* is connected to the connection portion 16 and the connection portion 18 and also supported by the peripheral wall portion 40*a*, by removing the portion of the wall portion 36 below the upper edge portion 36*b* other than the peripheral wall portion 40*a*, the internal combustion engine can be made light in weight while maintaining the rigidity of the cam cap 2 at a sufficient level.

(b) While the upper edge portion 36*b* extends straight in the first exemplary embodiment described above, the middle portion of the upper edge portion 36*b* may be bended upward so as to improve the reinforcement of the cam cap 2. In this case, the hydraulic oil distribution passage 38 is formed in a straight shape.

While the invention has been described with reference to the example embodiment thereof, it is to be understood that the invention is not limited to the example embodiment and construction. To the contrary, the invention is intended to cover various modifications and equivalent arrangements. In addition, while the various elements of the example embodiment are shown in various combinations and configurations, which are exemplary, other combinations and configurations, including more, less or only a single element, are also within the sprit and scope of the invention.

The invention claimed is:

1. A cam cap for an internal combustion engine, having an intake side cam cap portion for an intake camshaft and an exhaust side cam cap portion for an exhaust camshaft, which are integrally formed, comprising:

two connection portions that are formed at the intake side cam cap portion and the exhaust side cam cap portion, respectively, so as to protrude from the side of the cam cap opposite from where the camshaft support faces of the intake and exhaust side cam cap portions are formed, the connection portions having oil passage connection faces that are connected to corresponding oil passage connection faces of a cylinder head cover at which the openings of oil passages leading to ports of oil control valves are formed, respectively, so that oil passages in the exhaust and intake side cam cap portions are connected to the respective oil passages in the cylinder head cover;

a wall portion that extends between the connection portion of the intake side cam cap portion and the connection portion of the exhaust side cam cap portion; and a hydraulic oil distribution passage that is formed in the wall portion and through which a hydraulic oil supply passage formed in the connection portion of the intake side cam cap portion and a hydraulic oil supply passage formed in the connection portion of the exhaust side cam cap portion communicate with each other;

a hydraulic oil inlet passage that communicates with the hydraulic oil distribution passage and via which hydraulic oil is externally supplied into the hydraulic oil distribution passage.

2. The cam cap according to claim 1, wherein the wall portion is formed such that the entire part of the exhaust side cam cap portion including the connection portion and the entire part of the intake side cam cap portion including the connection portion are connected to each other via the wall portion.

3. The cam cap according to claim 1, wherein the upper edge portion of the wall portion extends straight.

4. The cam cap according to claim 3, wherein the upper edge portion of the wall portion is cylindrical, having a diameter larger than the thickness of the wall portion measured below the upper edge portion and extending between the connection portion of the intake side cam cap portion and the connection portion of the exhaust side cam cap portion, and in the upper edge portion, the hydraulic oil distribution passage extends straight between the hydraulic oil supply passage in the connection portion of the intake side cam cap portion and the hydraulic oil supply passage in the connection portion of the exhaust side cam cap portion, such that the entire part of the hydraulic oil distribution passage is located higher than the camshaft support faces of the exhaust and intake side cam cap portions.

5. The cam cap according to claim 1, wherein the hydraulic oil inlet passage is formed in the wall portion such that the lower opening of the hydraulic oil inlet passage is formed at the bottom face of the cam cap and the upper end of the hydraulic oil inlet passage is connected to an intermediate portion of the hydraulic oil distribution passage.

6. The cam cap according to claim 1, wherein the openings of the hydraulic oil supply passages for supplying hydraulic oil to the respective oil control valves and the openings of pressure-adjusting oil passages that supply or receive hydraulic oil at a pressure adjusted by the oil control valves are formed at the oil passage connection faces of the connection portions of the exhaust and intake side cam cap portions and the lower openings of the pressure-adjusting oil passages are formed at the camshaft support faces of the exhaust and intake side cam cap portions.

7. The cam cap according to claim 6, wherein the pressure-adjusting oil passage at the connection portion of each of the exhaust and intake side cam cap portions consists of two pressure-adjusting oil passages, and each of the oil control valves has a function of selectively supplying hydraulic oil from the hydraulic oil supply passage to one of the two pressure-adjusting oil passages while discharging hydraulic oil from the other of the two pressure-adjusting oil passages.

* * * * *